United States Patent [19]

Romer et al.

[11] 4,296,685

[45] Oct. 27, 1981

[54] WARHEAD WITH SLAVE MISSILES DISPOSED IN A FIRING TUBE

[75] Inventors: Rudolf Romer, Kaarst; Hans-Egon Schepp, Duesseldorf, both of Fed. Rep. of Germany

[73] Assignee: Rheinmetall GmbH, Duesseldorf, Fed. Rep. of Germany

[21] Appl. No.: 72,434

[22] Filed: Sep. 4, 1979

[30] Foreign Application Priority Data

Sep. 2, 1978 [DE] Fed. Rep. of Germany ..... 2838347

[51] Int. Cl.[3] ..... F42B 25/02

[52] U.S. Cl. ..... 102/387; 102/394

[58] Field of Search ..... 102/4, 5, 7.2

[56] References Cited

U.S. PATENT DOCUMENTS

| | | | |
|---|---|---|---|
| 1,289,483 | 12/1918 | Leal | 102/4 |
| 3,857,338 | 12/1974 | Bucklisch | 102/4 |
| 3,943,854 | 3/1976 | Zwicker | 102/7.2 |
| 3,948,175 | 4/1976 | Bucklisch | 102/5 |

*Primary Examiner*—Charles T. Jordan

[57] ABSTRACT

A plurality of warheads are disposed for ejection one behind the other, axially in a load-carrying missile with slave missiles disposed in firing tubes and parachutes connected to the warheads and causing their directional, braked descent in the target area. Proximity fuses cause the firing of the slave missiles. Each warhead consists of a firing tube which is open at both ends and in which two slave missiles are disposed with a common propellant charge between them. A parachute of each of the warheads is secured to the firing tube intermediate its length.

6 Claims, 3 Drawing Figures

WARHEAD WITH SLAVE MISSILES DISPOSED IN A FIRING TUBE

The invention relates to a plurality of warheads disposed axially in a load-carrying missile for ejection one behind the other, each warhead carrying slave missiles disposed in firing tubes and having a parachute connected thereto to cause a directional braked descent of the warhead in the target area; the slave missiles have proximity fuses which cause their firing.

Such warheads are disclosed in DE-OS No. 23 18 307 wherein firing tubes are pivotally secured to a central connecting element and which, in the folded state, are disposed in a missile casing; after leaving the missile casing the firing tubes automatically go into the extended position under the action of their weight. A brake parachute is connected to one or more of these warheads, while a stabilizing weight with a proximity fuse disposed at the tip causes the ignition and the firing of charges from the firing tubes at a certain distance from the ground.

This known warhead is intended to be brought with other similar warheads disposed axially one behind the other, to a target area by means of bombs, missiles or rockets, and there to cause an increased effect upon the target. This warhead is not suitable for direct firing from barrel weapons because it cannot withstand the high firing acceleration because of its mode of construction. Furthermore, the arrangement of the individual elements of the warhead takes up a great deal of space so that only a comparatively small number of such warheads can be conveyed in a rocket or a bomb. Finally, the deflection mechanism for the firing tubes and the locking mechanism to insure this position is mechanically complicated and leads to increased production costs.

It is among the objects of the present invention, while avoiding the disadvantages of the above described known warhead, to provide a warhead of very simple construction which is suitable for firing from a barrel weapon and which permits the maximum number of warheads to be disposed in a load-carrying missile.

In accordance with a preferred embodiment of the invention, a plurality of warheads are disposed for ejection one behind the other, axially in a load-carrying missile with slave missiles disposed in firing tubes, parachutes connected to the warheads causing a directional, braked descent of the warheads in the target area and proximity fuses causing the firing of the slave missiles. Each warhead consists of a firing tube which is open at both ends and in which two slave missiles are disposed with a common propellant charge between them. The parachute is secured to the firing tube centrally of its length. A plurality of warheads are disposed one behind the other and parallel to one another in the load-carrying missile. The cross-section of the firing tube is made different from a circular shape to provide a maximum packing density in the load-carrying missile. The firing tube has a bend in its central transverse plane so that the axes of the parts of the tube form an obtuse angle with the tip facing in the direction of fall of the warhead. The firing tube comprises a recess in its central region for a proximity fuse. A plurality of warheads are disposed in a three part packing envelope.

As a result of its rod-shaped construction, the warhead according to the invention offers the possibility of disposing a large number of similar warheads one behind the other, and side by side, axially in a load-carrying missile, so as at the same time to accommodate a large effective amount of explosive in the slave missiles as well as an adequate amount of propellant charge powder to fire from the warhead the slave missiles.

The individual warheads are accommodated in a three-part packing sleeve. This packing sleeve takes up the firing acceleration and protects the warheads from deformation or destruction.

The method of securing the parachute to the firing tube causes an automatic swinging of the firing tube into a horizontal, stable position, after its ejection from load-carrying missile and through the slight bend in the firing tube the effect is achieved that the slave missiles are fired at the target with a certain elevation with respect to the horizontal. By adapting the cross-section of the firing tube and of the slave missiles disposed therein to the requirements of as great a packing density as possible in the load-carrying missile, the whole available interior of a load-carrying missile can be utilized so that a particularly large number of firing tubes with slave missiles can be conveyed into the target area by one load-carrying missile.

Further details and advantages of the invention will be apparent from the following description taken with reference to the preferred embodiment illustrated in the drawings.

Figure 1:
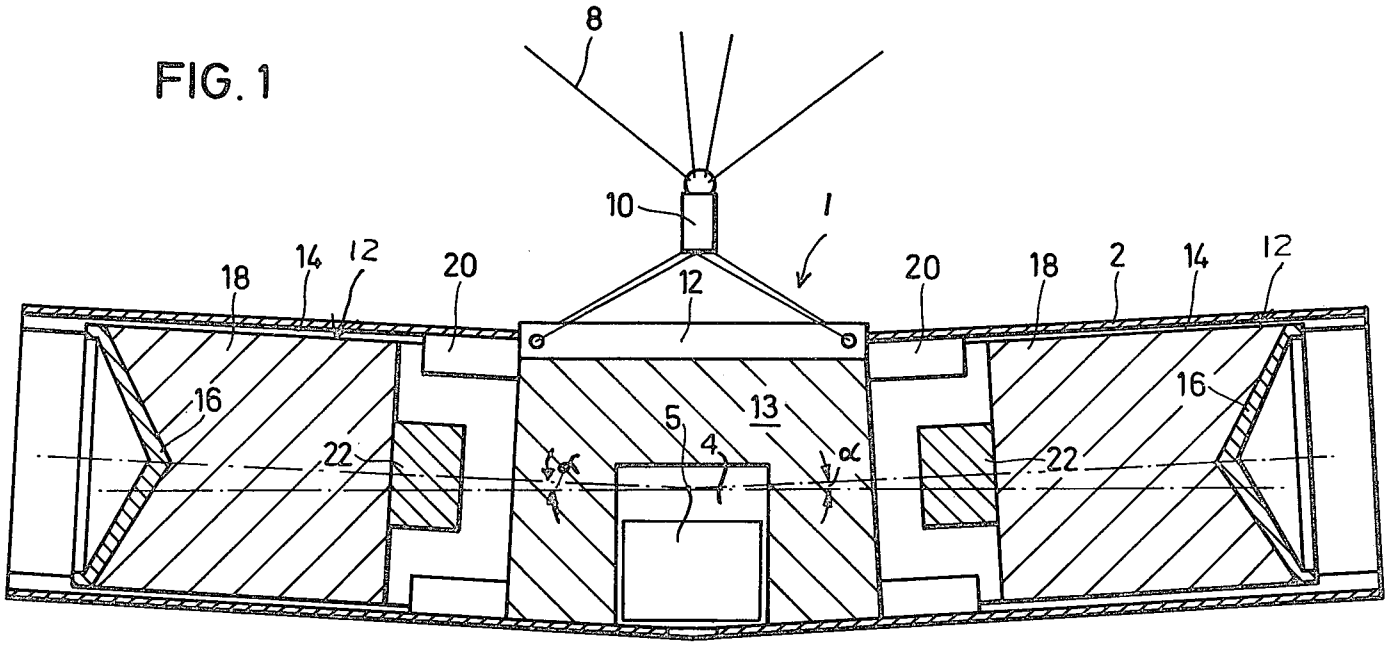
FIG. 1 is a view in longitudinal section through a warhead according to the invention with an unfolded parachute thereof indicated but not shown.
Figure 2:
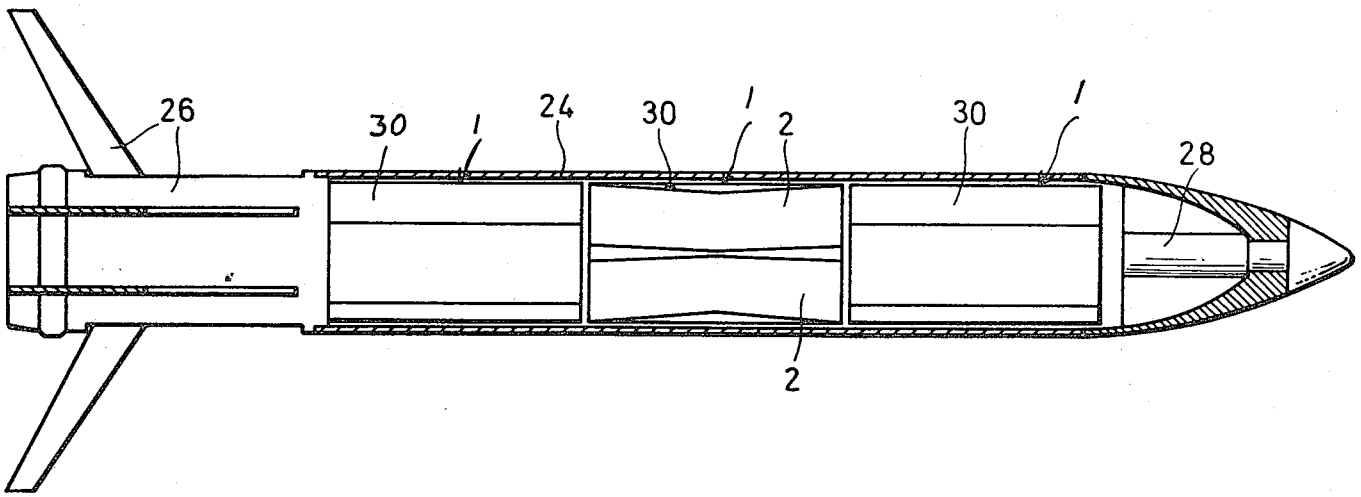
FIG. 2 is a view in longitudinal section through a load-carrying missile with the warheads disposed therein shown diagrammatically.
Figure 3:
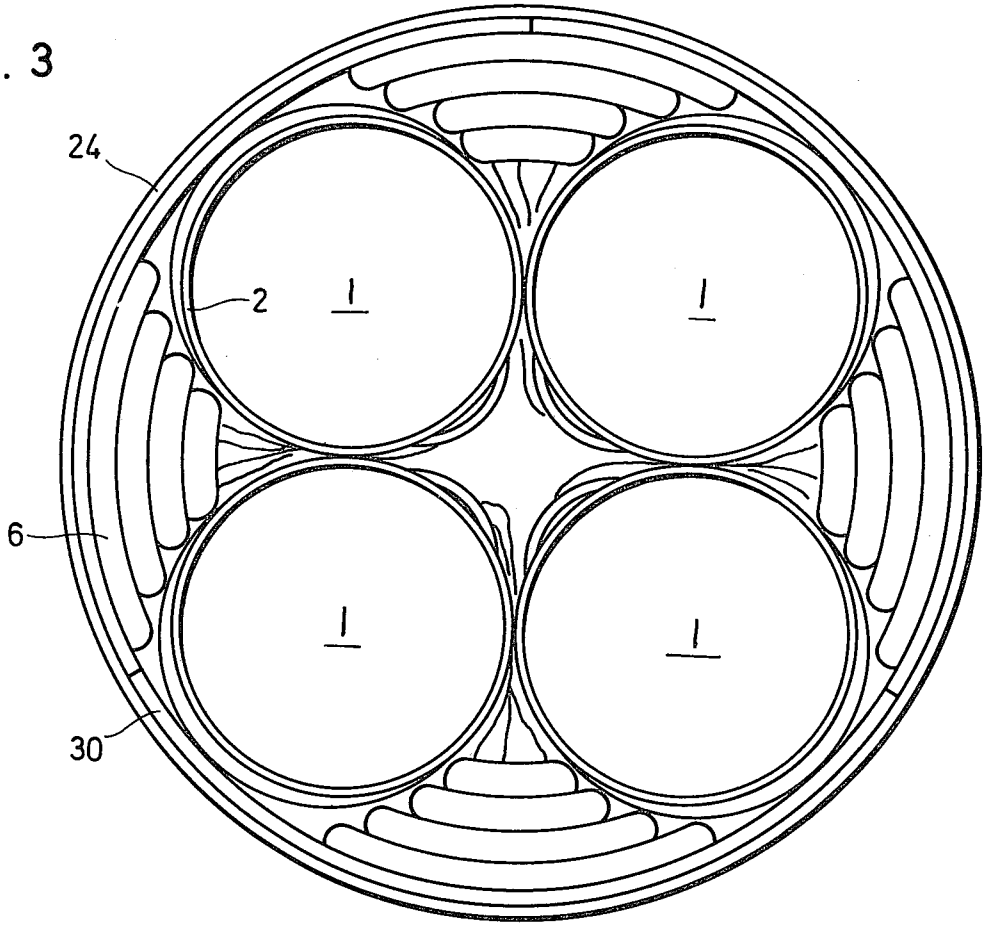
FIG. 3 is a view in cross-section through the load-carrying missile shown in FIG. 2.

The warhead 1 is constructed in the form of a firing tube 2 open at both ends and provided in the central region with a recess 4 in which a proximity fuse 5 is disposed. The two half-portions of the firing tube 2 are each inclined upwardly at an angle 2 with respect to the horizontal. A parachute 6 is disposed in a three-part packing sleeve 30. The parachute is secured by means of cords 8 and a ring 10 to a cross member 12 which is disposed above the center of gravity of the warhead. The proximity fuse 5 serves to ignite a propellant charge 13 disposed in the central region in the firing tube 2 when the firing tube 2 has sunk to a distance of 0.5 to 1.5 m from the ground. Disposed in the firing tube 2 are two slave missiles 12 which are provided with a hollowcharge sleeve 14 with a spike-forming insert 16 at the front end and an explosive charge 18. Provided at the rear end of the warhead are a wound tail unit 20 and a detonator 22. As a result of the ignition of the propellant charge 13, the two slave missles 12 are accelerated at the same speed in opposite directions, and after leaving the firing tube 2, the wound tail unit 20 unfolds and insures the stable flight of the slave missiles.

A large number of warheads are conveyed into the target area by a load-carrying missile 24. At the rear end, the load-carrying missile 24 comprises a hinged tail unit 26 and at the front end an ejection charge 28, while in the middle cylindrical region in the example illustrated, three bundles of four warheads are disposed one behind the other.

In the vicinity of the target area, the ejection charge 28 of the load-carrying missile 24 is ignited, the hinged tail unit 26 is separated from the load-carrying missile 24, and the warheads 1 are ejected towards the rear. After such ejection, the parachutes 6 unfold and the warheads 1 float down directionally and are braked into the target area.

In order to increase the packing density within the load-carrying missile it is possible to give the firing tube 2 and the slave missiles 12 a cross-section differing from a circular shape so that the warheads can be packed without gaps in the load-carrying missile 24. The number of warheads disposed in the load-carrying missile 24 then depends only on the mass of the maximum useful load which can be conveyed by it.

Although the invention is illustrated and described with reference to one preferred embodiment thereof, it is to be expressly understood that it is in no way limited to the disclosure of such a preferred embodiment, but is capable of numerous modifications within the scope of the appended claims.

We claim:

1. In a warhead adapted to be disposed with a plurality of similar warheads axially in a load-carrying missile for ejection therefrom behind the other, the warhead carrying slave missiles disposed in firing tubes, the warhead having a parachute connected thereto to cause the directional, braked descent thereof in the target area, the slave missiles having proximity fuses causing their firing, the improvement wherein the warhead comprises a firing tube which is open at both ends and in which two slave missiles are disposed with a common propellant charge between them, the parachute being secured to the firing tube centrally of the length of the firing tube.

2. A warhead as claimed in claim 1, wherein a plurality of warheads are disposed one behind the other and parallel to one another in a load-carrying missile.

3. A warhead as claimed in claim 2, in which the cross-section of the firing tube is made different from a circular shape to provide a maximum packing density in the load-carrying missile.

4. A warhead as claimed in claim 1, wherein the firing tube has a bend in its central transverse plane so that the axes of the end portions of the firing tube form an obtuse angle with the tip facing in the direction of fall of the warhead.

5. A warhead as claimed in claim 1, wherein the firing tube comprises a recess in the central portion thereof to receive the proximity fuse.

6. A warhead as claimed in claim 1, wherein a plurality of warheads are disposed in a three-part packing envelope.

* * * * *